US008998539B2

(12) United States Patent
Saint-Marcoux et al.

(10) Patent No.: US 8,998,539 B2
(45) Date of Patent: Apr. 7, 2015

(54) HYBRID RISER TOWER AND METHODS OF INSTALLING SAME

(75) Inventors: Jean-Francois Saint-Marcoux, Paris (FR); Gregoire De-Roux, Paris (FR); Jean-Pierre Branchut, Houston, TX (US)

(73) Assignee: Acergy France SAS, Suresnes (FR)

( * ) Notice: Subject to any disclaimer, the term of this patent is extended or adjusted under 35 U.S.C. 154(b) by 103 days.

(21) Appl. No.: 13/460,777

(22) Filed: Apr. 30, 2012

(65) Prior Publication Data

US 2012/0292039 A1 Nov. 22, 2012

Related U.S. Application Data

(63) Continuation-in-part of application No. 12/513,840, filed as application No. PCT/GB2007/050675 on Nov. 6, 2007, now Pat. No. 8,186,912.

(60) Provisional application No. 60/857,572, filed on Nov. 8, 2006.

(30) Foreign Application Priority Data

Mar. 10, 2007 (GB) ..... 0704670.9

(51) Int. Cl.
*E21B 17/01* (2006.01)
*E21B 17/10* (2006.01)

(52) U.S. Cl.
CPC ..... *E21B 17/012* (2013.01); *E21B 17/1035* (2013.01)

(58) Field of Classification Search
USPC ..... 405/224.2, 224; 166/345
See application file for complete search history.

(56) References Cited

U.S. PATENT DOCUMENTS

| | | | | |
|---|---|---|---|---|
| 4,271,550 | A | 6/1981 | Joubert et al. | 441/133 |
| 4,645,467 | A | 2/1987 | Pollack | 441/4 |
| 5,437,302 | A * | 8/1995 | Da Silva et al. | 137/242 |

(Continued)

FOREIGN PATENT DOCUMENTS

| | | |
|---|---|---|
| DE | 39 34 253 A1 | 4/1990 |
| EP | 0 071 551 A1 | 2/1983 |

(Continued)

OTHER PUBLICATIONS

Saint-Marcoux, J. et al., "Hybrid Riser Tower: from Functional Specification to Cost per Unit Length," DOT XIII Rio de Janeiro, Oct. 18, 2001.

*Primary Examiner* — Benjamin Fiorello
*Assistant Examiner* — Kyle Armstrong
(74) *Attorney, Agent, or Firm* — Levy & Grandinetti

(57) ABSTRACT

Disclosed is a riser including a plurality of pipelines. In one example there are three such pipelines extending from the seabed toward the surface and having an upper end supported at a depth below the sea surface. In one embodiment, a first of the pipelines acts as a central structural core, and the other pipelines are arranged around the first pipeline. In another embodiment, three pipelines are arranged around a structural core. In each case, the first of the pipelines can be a fluid injection line, and the other pipelines are production lines. Also disclosed is a riser having buoyancy along at least a part of its length. The buoyancy results in the riser having a generally circular cross-section, the circumference of which is non-contiguous. Methods of installing such risers are also described.

12 Claims, 11 Drawing Sheets

(56) References Cited

U.S. PATENT DOCUMENTS

| | | | | |
|---|---|---|---|---|
| 5,706,897 | A * | 1/1998 | Horton, III | 166/359 |
| 5,873,416 | A * | 2/1999 | Horton, III | 166/344 |
| 5,881,815 | A * | 3/1999 | Horton, III | 166/350 |
| 5,979,506 | A * | 11/1999 | Aarseth | 138/33 |
| 6,082,391 | A | 7/2000 | Thiebaud et al. | |
| 6,321,844 | B1 | 11/2001 | Thiebaud et al. | 166/345 |
| 6,769,376 | B2 * | 8/2004 | Perera et al. | 114/230.13 |
| 6,893,190 | B2 | 5/2005 | Macrea et al. | 405/209 |
| 2002/0168232 | A1 * | 11/2002 | Xu et al. | 405/224 |
| 2003/0141070 | A1 * | 7/2003 | Davies et al. | 166/350 |
| 2004/0074648 | A1 * | 4/2004 | Legras et al. | 166/347 |
| 2004/0076478 | A1 * | 4/2004 | Legras et al. | 405/224.2 |
| 2005/0063788 | A1 | 3/2005 | Clausen | 405/224.2 |
| 2007/0044972 | A1 | 3/2007 | Roveri et al. | 166/367 |

FOREIGN PATENT DOCUMENTS

| | | | |
|---|---|---|---|
| EP | 0 114 660 | A2 | 8/1984 |
| EP | 1 271 044 | A1 | 1/2003 |
| FR | 2 029 884 | | 10/1970 |
| FR | 2 768 457 | | 3/1999 |
| FR | 2 809 136 | | 11/2001 |
| GB | 1 203 355 | | 8/1970 |
| GB | 1 312 544 | A | 4/1973 |
| GB | 1 348 318 | | 3/1974 |
| GB | 2 173 562 | A | 10/1986 |
| GB | 2 315 835 | A | 2/1998 |
| GB | 2 419 171 | A | 4/2006 |
| WO | WO 99/57413 | | 11/1999 |
| WO | WO 01/14637 | | 3/2001 |
| WO | WO 02/053869 | A1 | 7/2002 |
| WO | WO 02/063128 | A1 | 8/2002 |
| WO | WO 2004/051051 | | 6/2004 |
| WO | WO 2005/103436 | A1 | 11/2005 |
| WO | WO 2006/136960 | | 12/2006 |

* cited by examiner

HYBRID RISER TOWER AND METHODS OF INSTALLING SAME

This application is a continuation-in-part of U.S. patent application Ser. No. 12/513,840 filed Mar. 9, 2010, which is the U.S. National Phase of International Application No. PCT/GB2007/050675 filed on Nov. 6, 2007, which claims priority to Great Britain Application No. 0704670.9 filed on Mar. 10, 2007, and U.S. Provisional Application No. 60/857,572 filed on Nov. 8, 2006.

The present invention relates to hybrid riser towers and in particular hybrid riser towers for a drill centre.

Hybrid Riser Towers are known and form part of the so-called hybrid riser, having an upper and/or lower portions ("jumpers") made of flexible conduit and suitable for deep and ultra-deep water field development. U.S. Pat. No. 6,082,391 (Stolt/Doris) proposes a particular Hybrid Riser Tower (HRT) consisting of an empty central core, supporting a bundle of riser pipes, some used for oil production some used for water and gas injection. This type of tower has been developed and deployed for example in the Girassol field off Angola. Insulating material in the form of syntactic foam blocks surrounds the core and the pipes and separates the hot and cold fluid conduits. Further background has been published in paper "Hybrid Riser Tower: from Functional Specification to Cost per Unit Length" by J-F Saint-Marcoux and M Rochereau, DOT XIII Rio de Janeiro, 18 Oct. 2001. Updated versions of such risers have been proposed in WO 02/053869 A1. The contents of all these documents are incorporated herein by reference, as background to the present disclosure. These multibore HRTs are very large and unwieldy, cannot be fabricated everywhere, and reach the limit of the component capabilities.

One known solution is to use a number of Single Line Offset Risers (SLORs) which are essentially monobore HRTs. A problem with these structures is that for a drill centre (a cluster of wells), a large number of these structures are required, one for each production line, each injection line and each gas line. This means that each structure needs to be placed too close to adjacent structures resulting in the increased risk of each structure getting in the way of or interfering with others, due to wake shielding and wake instability.

Another problem with all HRTs is vortex induced vibration (alternating shedding of trailing vortexes), which can lead to fatigue damage to drilling and production risers.

The invention aims to address the above problems.

In a first aspect of the invention there is provided a riser comprising a plurality of conduits extending from the seabed toward the surface and having an upper end supported at a depth below the sea surface, wherein a first of said conduits acts as a central structural core, said other conduits being arranged around said first conduit.

Said other conduits are preferably arranged substantially symmetrically around said first conduit.

In a main embodiment said first conduit is a fluid injection line and said other conduits consist of production lines, Said riser preferably comprising two such production lines. At least one of said production lines may be thermally insulated. In one embodiment both production lines are thermally insulated. Alternatively, only one of said production lines is thermally insulated, the uninsulated line being used as a service line. Said thermal insulation may be in the form of a pipe in pipe structure with the annular space used as a gas lift line. Said fluid injection line may be a water or gas injection line.

Said riser may further comprise buoyancy. Said buoyancy may be in the form of blocks located at intervals along the length of the riser. Said blocks may be arranged symmetrically around said first conduit to form a substantially circular cross-section. Said foam blocks are preferably arranged non-contiguously around said first conduit.

Said production lines may provide a pigging loop.

In a further aspect of the invention there is provided a riser comprising three conduits arranged substantially symmetrically around a central core, said conduits extending from the seabed toward the surface and having an upper end supported at a depth below the sea surface, wherein a first of said conduits is a fluid injection line, said other conduits being production lines.

Said production lines may provide a pigging loop.

In a main embodiment said first conduit is a water injection line and said other conduits consist of production lines. Two such production lines may be provided. At least one of said production lines may be thermally insulated. In one embodiment both production lines are thermally insulated. Alternatively, only one of said production lines is thermally insulated, the uninsulated line being used as a service line. Said thermal insulation may be in the form of a pipe in pipe structure with the annular space used as a gas lift line.

Said riser may further comprise buoyancy. Said buoyancy may be in the form of blocks located at intervals along the length of the riser. Said blocks may be arranged symmetrically around said first conduit to form a substantially circular cross-section. Said foam blocks are preferably arranged non-contiguously around said first conduit.

Said riser may further comprise a plurality of guide frame elements arranged at intervals along the length of said riser, said frame elements guiding said conduits in place. Sliding devices between the risers and the guide frames may be included to allow sliding and dampen Vortex Induced Motion.

Said structural core may also be used as a conduit, either as a production line, injection line or gas lift line.

In a further aspect of the invention there is provided a riser comprising a plurality of conduits extending from the seabed toward the surface and having an upper end supported at a depth below the sea surface wherein said riser is provided with buoyancy along at least a part of its length, said buoyancy resulting in said riser having a generally circular cross-section, the circumference of which being non-contiguous.

Generally circular in this case means that the general outline of the riser in cross section is circular (or slightly oval/ovoid) even though the outline is non-contiguous and may have considerable gaps in the circular shape, wherein a width of the gap is greater than a radius of each conduit of the plurality of conduits guided by a respective guide frame to allow access to the plurality of conduits without removing any of the buoyant blocks.

Said buoyancy may be in the form of blocks located at intervals along the length of the riser. Said blocks may be arranged symmetrically around said first conduit to form said largely circular cross-section. Said foam blocks are preferably arranged such that there are gaps between adjacent blocks to obtain said non-contiguous profile.

A first of said conduits may act as a central structural core, said other conduits being arranged around said first conduit. Said other conduits are preferably arranged substantially symmetrically around said first conduit. In a main embodiment said first conduit is a fluid injection line and said other conduits consist of production lines. Said fluid injection line may be a water or gas injection line. Alternatively said riser may comprise three conduits arranged substantially symmetrically around a central core, wherein a first of said conduits is a fluid injection line, said other conduits being production lines.

Two such production lines may be provided. At least one of said production lines may be thermally insulated. In one embodiment both production lines are thermally insulated. Alternatively, only one of said production lines is thermally insulated, the uninsulated line being used as a service line. Said thermal insulation may be in the form of a pipe in pipe structure with the annular space used as a gas lift line.

In a further aspect of the invention there is provided a method of installing a riser, said riser comprising a plurality of conduits extending from the seabed toward the surface and having an upper end supported at a depth below the sea surface by a buoyancy module, said riser being assembled at a place other than the installation site and transported thereto in a substantially horizontal configuration wherein said buoyancy module is attached to said riser by a non-rigid connection prior to said riser being upended to a substantially vertical working orientation.

Said connection between the buoyancy module and the riser may be made at the installation site. Said non-rigid connection may be made using a chain. Said chain may be provided in two parts during transportation, with a first part connected to the riser (either directly or indirectly) and a second part connected to the buoyancy module (either directly or indirectly) while being transported. Said parts may be of approximately equal length. Said parts may each be in the region of 10 m to 30 m long. The two parts may be connected together on a service vessel. In order to provide room to make the connection, the buoyancy tank may first be rotated. Said rotation may be through approximately 90 degrees.

Said buoyancy module may be towed to the installation site with the riser. Said buoyancy module may be towed behind said riser by connecting a towing line between the riser and the buoyancy module, independent of any other towing lines.

In one embodiment, in which the riser and buoyancy module are transported together by a first, leading, vessel and second, trailing, vessel the method may comprise the following steps:

- the second vessel, connected by a first line to the top end of the riser during transportation, pays in said line and moves toward the riser,
- the Buoyancy module is rotated approximately 90 degrees,
- the permanent connection between riser and buoyancy module is made on a service vessel;
- a second line, which connected the top of the buoyancy module to the top of the riser during transportation, is disconnected from said riser and passed to said second vessel;

Said first line is disconnected,

The riser upending process begins.

Reference to "top" and "bottom" above is to be understood to mean the top and bottom of the item referred to when it is installed.

In a further aspect of the invention there is provided a method of accessing a coil tubing unit located substantially at the top of a riser structure, said riser structure comprising a plurality of conduits extending from the seabed toward the surface and having an upper end supported at a depth below the sea surface by a buoyancy module, wherein said method comprises attaching a line to a point substantially near the top of said riser, and exerting a force on said line to pull said riser, or a top portion thereof, from its normal substantially vertical configuration to a configuration off vertical.

The riser's normal substantially vertical configuration should be understood to cover orientations off true vertical, yet vertical in comparison to other riser systems.

Said buoyancy module may be attached to said riser (directly or indirectly) by means of a non-rigid connection such as a chain. Said line is preferably attached to a lower portion of said buoyancy module. The tension on said line may therefore also cause said buoyancy module to be moved a distance laterally away from the vertical axis of said riser, thereby allowing access to the coil tubing unit from directly above.

Said tension may be exerted on said line by means of a winch or similar device. Said winch may be located on a Floating Production, Storage and Offloading (FPSO) Vessel.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
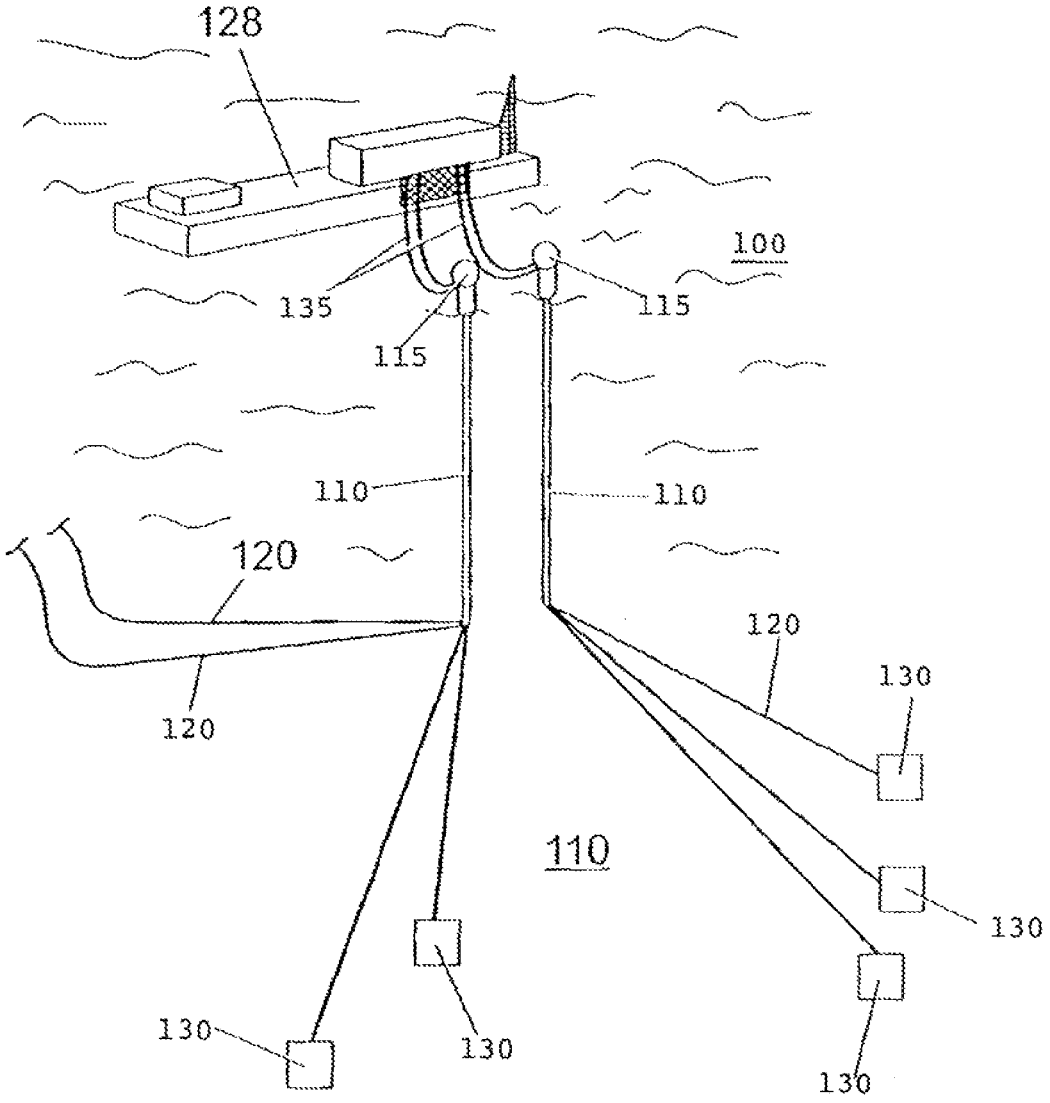
Fig. 1 PRIOR ART
FIG. 1 shows a known type of riser structure in an offshore oil production system.

FIG. 1 illustrates a floating offshore structure 100 fed by riser bundles 110, which are supported by subsea buoys 115. Spurs 120 extend from the bottom of the riser bundle to the various well heads 130. The floating structure is kept in place by mooring lines (not shown), attached to anchors (not shown) on the seabed. The example shown is of a type known generally from the Girassol development, mentioned in the introduction above.

Each riser bundle is supported by the upward force provided by its associated buoy 115. Flexible jumpers 135 are then used between the buoys and the service vessel 128. The tension in the riser bundles is a result of the net effect of the buoyancy combined with the ultimate weight of the structure and risers in the seawater. The skilled person will appreciate that the bundle may be a few meters in diameter, but is a very slender structure in view of its length (height) of for example 500 m, or even 1 km or more. The structure must be protected from excessive bending and the tension in the bundle is of assistance in this regard.

Hybrid Riser Towers (HRTs), such as those described above, have been developed as monobore structures or as structures comprising a number, in the region of six to twelve, of risers arranged around a central structural core.

It is normal for deepwater developments to be phased and are often built around a drill centre. A drill centre is usually of two piggable production lines (at least one being thermally insulated) and an injection line.

Figure 2:
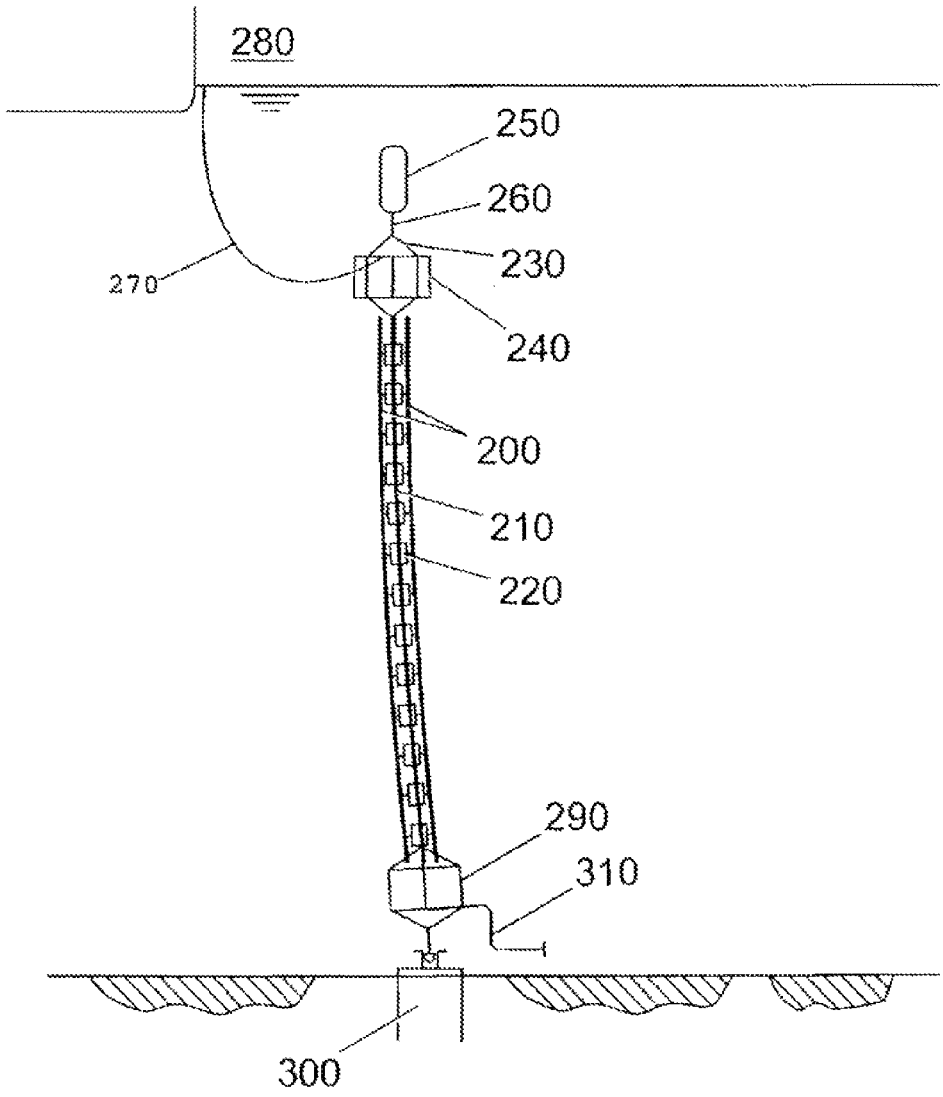
FIG. 2 shows a riser structure according to an embodiment of the invention.

FIG. 2 shows a simplified multibore hybrid riser tower designed for a drill centre. It comprises two (in this example) production lines 200, a water injection line 210, buoyancy blocks 220, an Upper Riser Termination Assembly (URTA) 230 with its own self buoyancy 240, a buoyancy tank 250 connected to the URTA by a chain 260, jumpers 270 connecting the URTA 230 to a Floating Production Unit (FPU) 280. At the lower end there is a Lower Riser Termination Assembly (LRTA) 290, a suction or gravity or other type of anchor 300, and a rigid spool connection 310. This spool connection 310 can be made with a connector or an automatic tie-in system (such as the system known as MATIS® and described in WO03/040602 incorporated herein by reference). It should be noted that instead of the water injection line 210, the riser tower may comprise a gas injection line.

As mentioned previously, conventional HRTs usually comprise a central structural core with a number of production and injection lines arranged therearound. In this structure. however, the water injection line 210 doubles as a central core for the HRT structure, with the two production lines arranged either side, on the same plane, to give a flat cross-section.

The inventors have identified that for a small isolated reservoir the minimum number of lines required are three, two production lines to allow pigging and one injection line to maintain pressure.

Figure 4A:
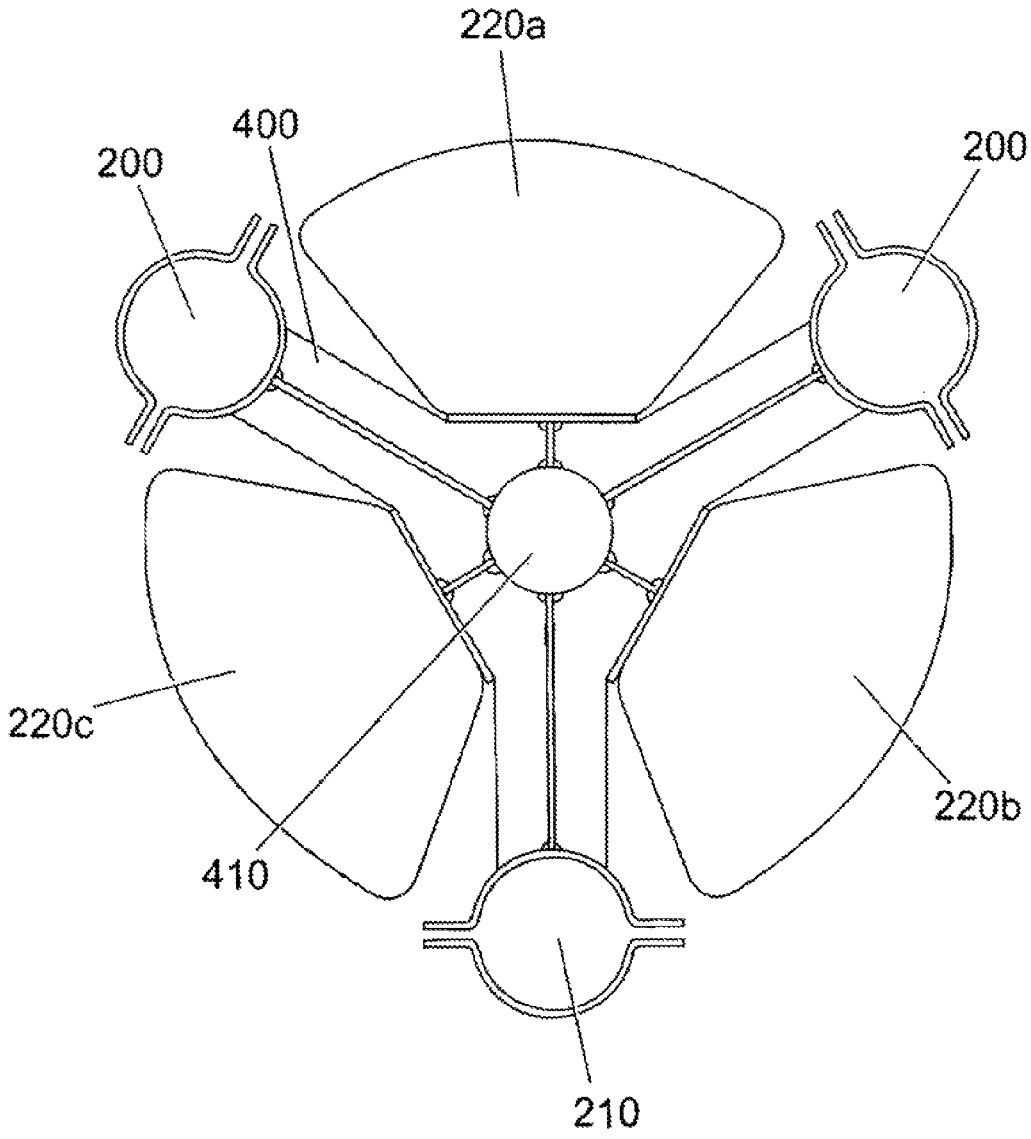
FIGS. 4*a*, 4*b* and 4*c* show, respectively, an alternative riser structure in cross section, a section of the alternative riser tower in perspective, and a modified version of the alternative riser structure in cross section.
Figure 4B:
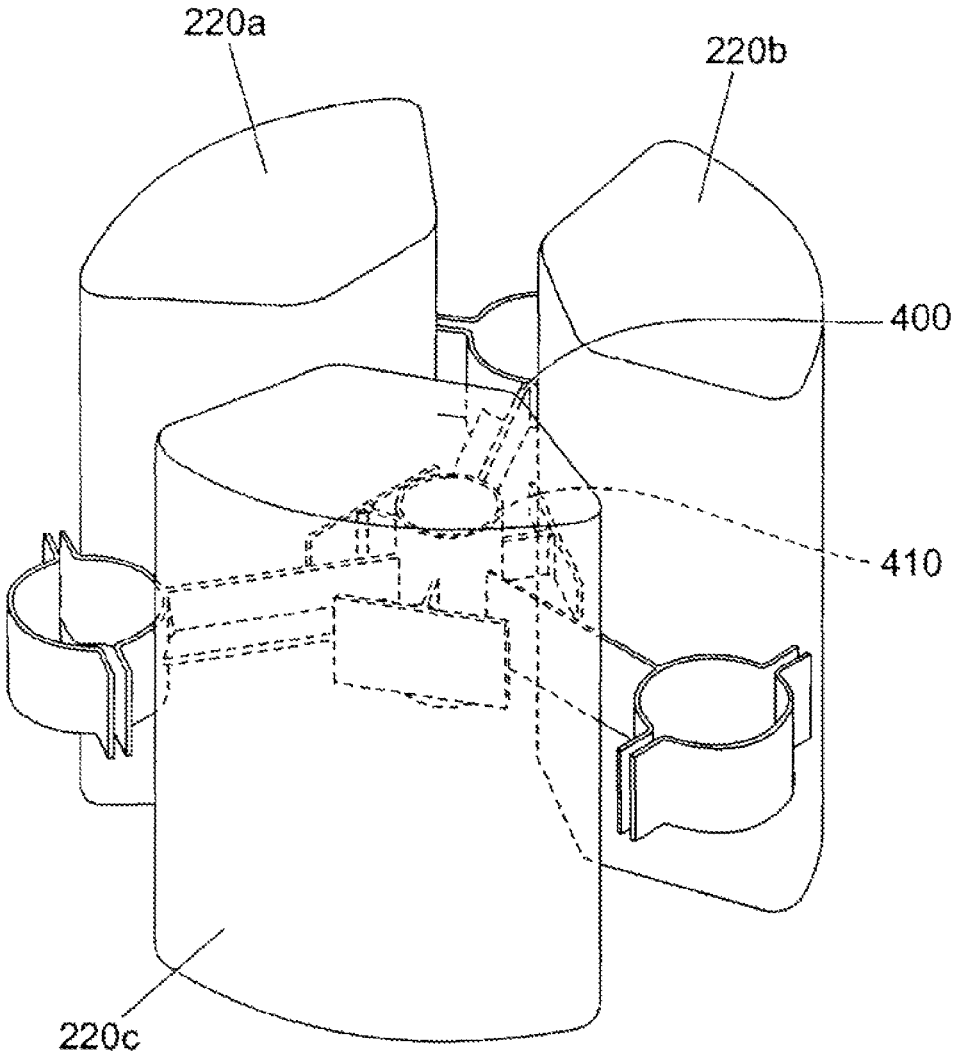
Figure 4C:
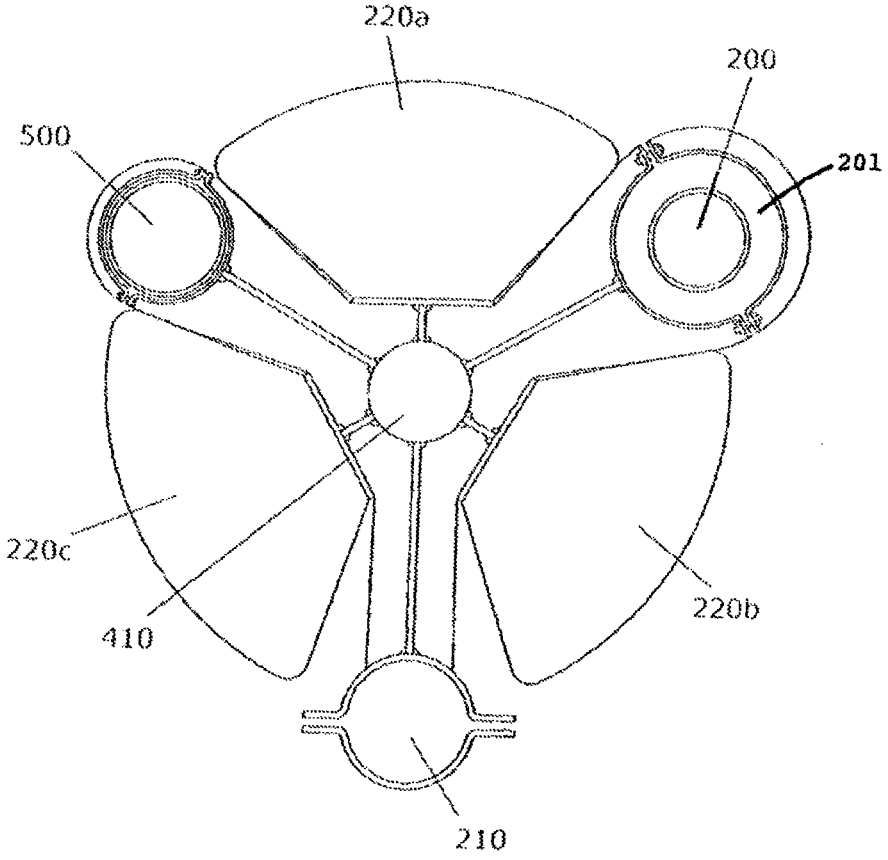
Figure 5A:
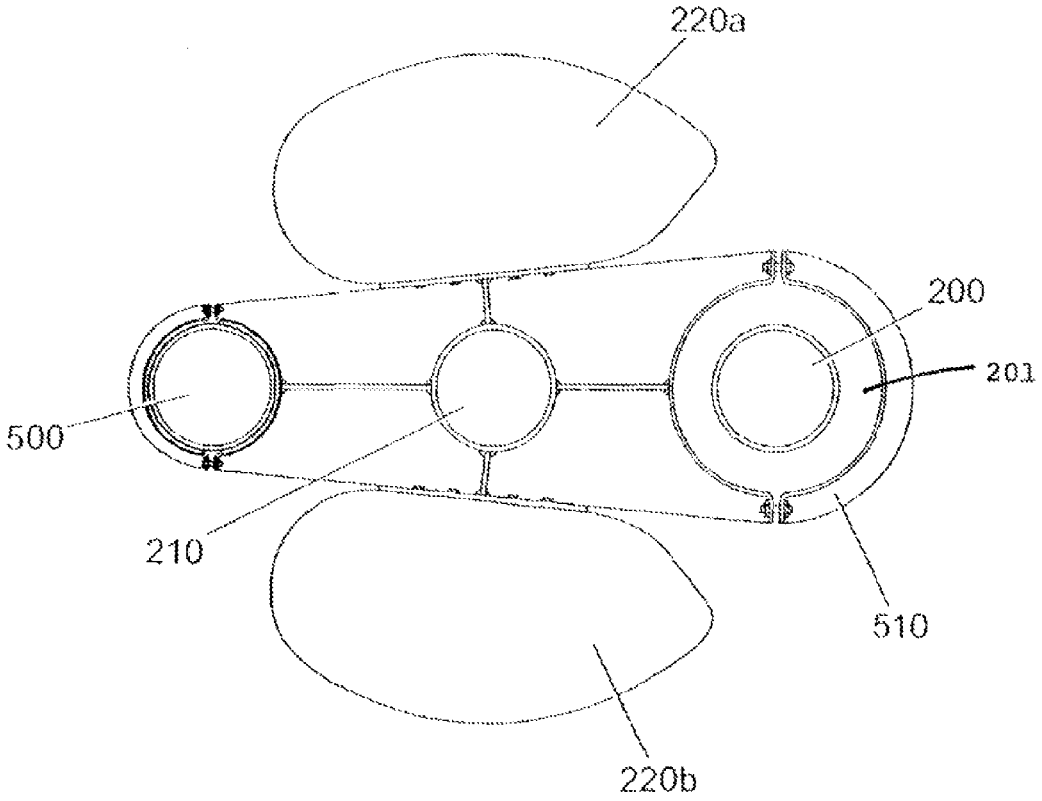
FIGS. 5*a* and 5*b* show, respectively, an alternative riser structure and a modified alternative riser structure in cross-section.
Figure 5B:
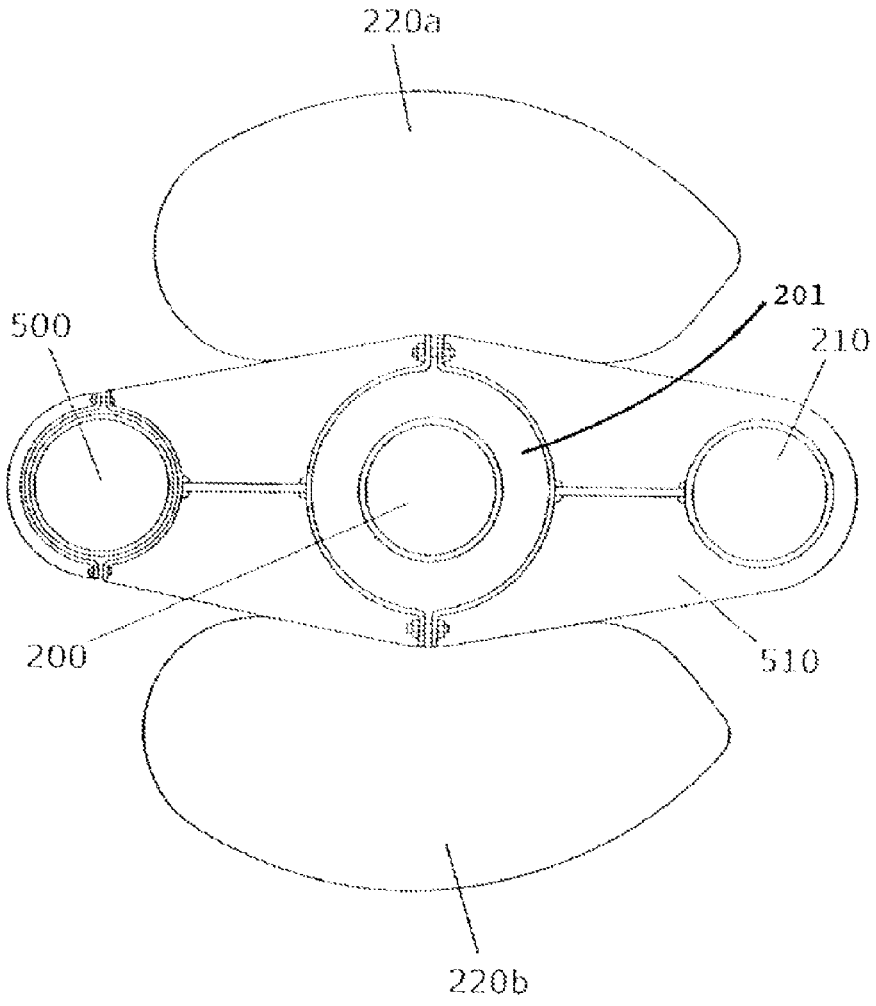

The risers themselves may be fabricated onshore as horizontally sliding pipe-in-pipe incorporating annular gas lift lines 201 (as illustrated in FIGS. 4*c*, 5*a*, and 5*b*) although separate gas lift lines can also be envisaged. The top connection of an annulus pipe-in-pipe can be performed by welding a bulkhead or by a mechanical connection.

Figure 3A:
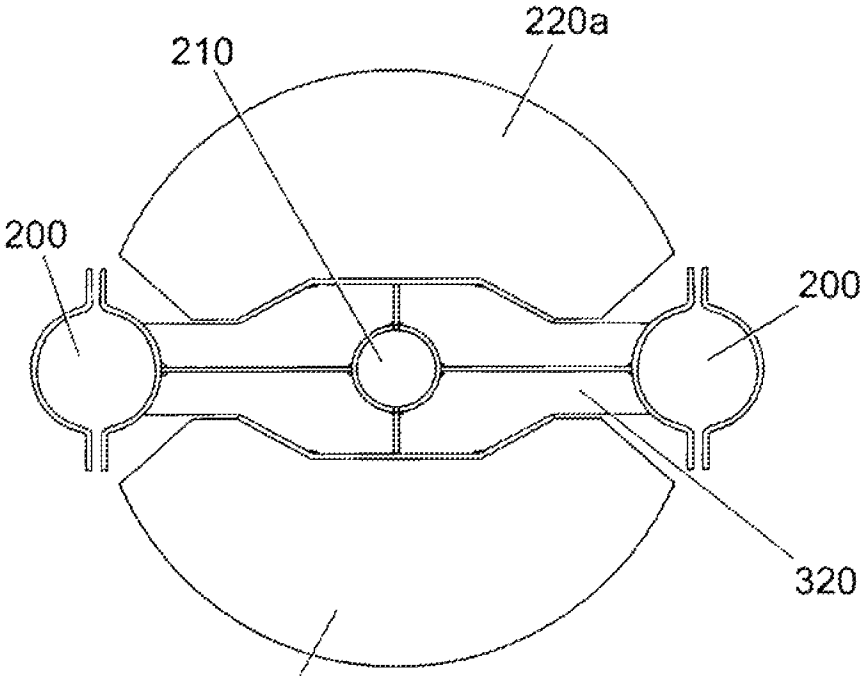
FIGS. 3*a* and 3*b* show, respectively, the riser structure of FIG. 2 in cross section and a section of the riser tower in perspective.
Figure 3B:
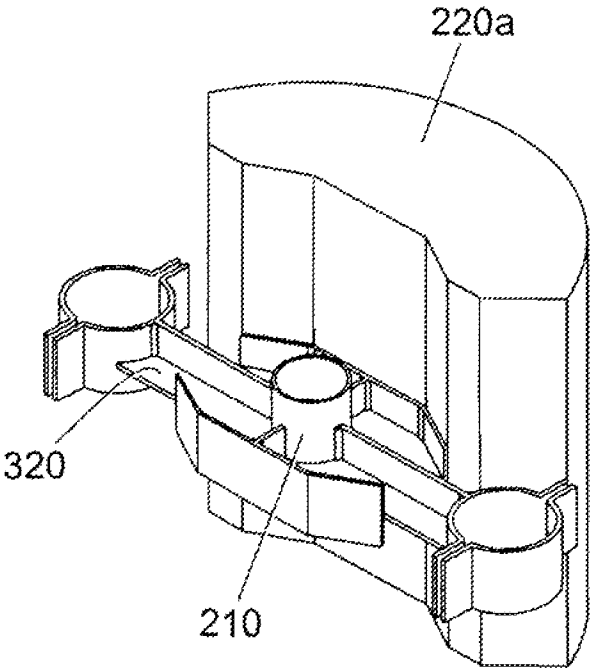

FIGS. 3*a* and 3*b* show, respectively, the riser tower in cross section and a section of the riser tower in perspective. This shows the two production lines 200, the water injection line/central core 210, guide frame 320 and buoyancy foam blocks 220*a*, 220*b*. The guide frame 320 holds the three lines 200, 210 in place, in a line. A plurality of these guide frames 320 are comprised in the HRT, arranged at regular intervals along its length.

It can also be seen that the buoyancy blocks 220*a*, 220*b* are arranged non-contiguously around the water injection line/riser core. For an onshore-assembled HRT, the riser assembly must be buoyant so that, in the event of loss of the HRT by the tugs towing it, it will not sink. Buoyancy of the HRT once installed is provided by the addition of the buoyancy 230 along the riser assemble and the buoyancy provided by the buoyancy element 250 at the top. Attaching buoyancy foam blocks to the risers themselves would reduce the compression in the core pipe but the hydrodynamic section would become very asymmetrical. Therefore, it is preferred for the foam blocks to be attached to the core pipe/guide frame as shown.

The fact that the foam blocks are arranged non-contiguously around the HRT (as well as being applied non-contiguously along its length) minimises the occurrence of Vortex Induced Vibration (VIV) in the riser tower. A conventional completely circular cross-section causes a wake, while the breaking up of this circular outline breaks the wake, resulting in a number of smaller eddy currents instead of one large one, and consequently reduced drag. The riser cross-section should still maintain a largely circular (or slight ovoid) profile, as there is no way of knowing the water current direction, so it is preferable that the structure should be as insensitive to direction as possible.

The distance between guide frames is governed by the amount of compression in the core pipe. Guiding devices are required between the guide frame and the riser.

FIGS. 4*a* and 4*b* show an alternative embodiment to that described above wherein the two production lines 200 and the single water injection line/gas injection line 210 is arranged symmetrically around a structural core 410. As before there are guide frames 400 and buoyancy foam blocks 220*a*, 220*b*, 220*c* arranged non-contiguously around the core 410. It is possible in this embodiment for the structural core to be used as a line, should a further line be desired.

FIG. 5*a* shows a variation of the embodiment depicted in FIGS. 3*a* and 3*b*. In this variation instead of two identical insulated production lines there is provided only one insulated production line 200 and one non-insulated service line 500. As before, the water/gas injection line 210 acts as the structural core for the riser tower, and there are provided guide frames 510 at intervals along the length with buoyancy blocks 220*a*, 220*b* attached thereto. Under normal conditions the production comes through the insulated line. The service line is always filled with dead oil (not likely to form hydrates). Upon shutdown dead oil from the service line is pushed back into the production line.

The embodiment of FIGS. 4*a* and 4*b* may also employ an insulated production line and a non-insulated service line as shown in the FIG. 5*a* embodiment in place of the two production lines 200—this arrangement is shown in FIG. 4*c*. The FIG. 5*a* embodiment may also be modified so that the insulated production line 200, rather than the water injection line 210, is provided as the structural core for the riser tower—this arrangement is shown in FIG. 5*b*. In either case, the service line is used in the same way as described for the FIG. 5*a* embodiment.

It should be noted that the hybrid riser is constructed onshore and then towed to its installation site were it is upended and installed. In order to be towed the riser is made neutrally buoyant (or within certain tolerances). Towing is done by at least two tugs, one leading and one at the rear.

Figure 6:
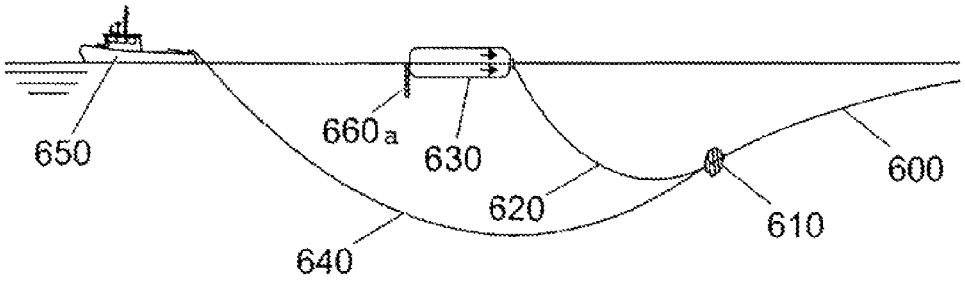
FIG. 6 shows a riser structure with buoyancy tank being towed to an installation site.

FIG. 6 shows (in part) a hybrid riser being towed to an installation site prior to being upended and installed. It shows the riser 600, and at what will be its top when installed, an upper riser installation assembly (URTA) 610. Attached to this via buoyancy tank tow line 620 is the main top buoyancy tank 630 floating on the sea surface. The URTA 610 is also attached to a trail tug 650 (the lead tug is not shown) about 650 meters behind the URTA via riser tow line 640. A section of the main permanent chain link 660*a*, attached to the buoyancy tank 630 and for making the permanent connection between this and the URTA 610, can also be seen, as yet unconnected. It should be noted that the buoyancy tank tow line 620 is actually attached to the top of the buoyancy tank 630, that is the buoyancy tank 630 is inverted compared to the riser 600 itself.

Figure 7:
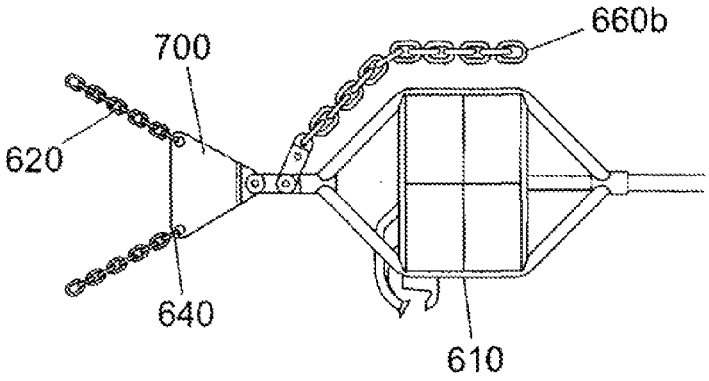
FIG. 7 shows in detail the towing connection assembly used in FIG. 6

FIG. 7 shows in detail the rigging of the URTA 610. This shows a triplate with swivel 700 which connects the URTA 610 (and therefore the riser 600) to the buoyancy tank 630 and trail tug 650 by buoyancy tank tow line 620 and riser tow line 640 respectively. Also shown is the other section of the permanent chain link 660*b* attached to the top of the URTA 610.

By using a chain to connect the buoyancy tank to the riser (instead of, for example a flexjoint) and by making the chain link long enough (say each section 660*a*, 660*b* being about 20 meters in length) it becomes possible to attach the buoyancy tank 630 to the riser 600 by joining these two sections 660*a*, 660*b* together at the installation site prior to upending. This dispenses with the need to have a heavy installation vessel with crane to hold and install the buoyancy tank when upended. Only service vessels are required. It also allows the possibility of towing the buoyancy tank with the riser to the installation site thus reducing cost. Furthermore, the use of a chain instead of a rigid connection dispenses with the need for a taper joint.

Figure 8A:
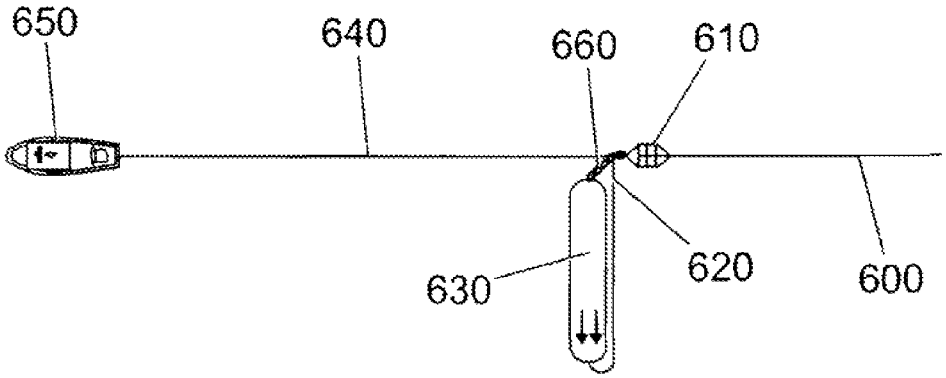
FIGS. 8*a* and 8*b* depict two steps in the installation method according to an embodiment of the invention.
Figure 8B:
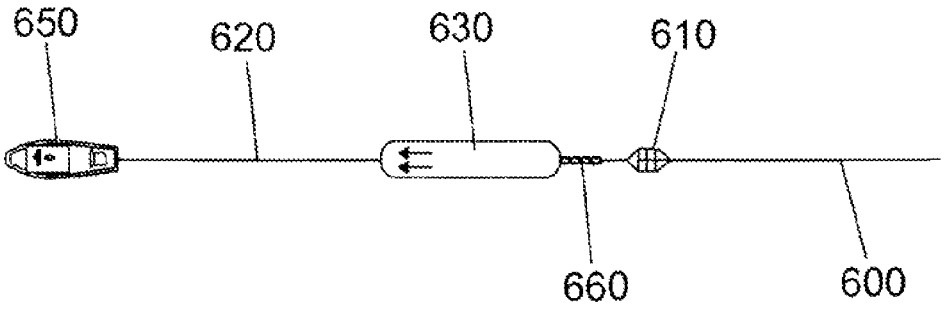

FIGS. 8*a* and 8*b* show the trail tug and apparatus of FIG. 6 during two steps of the installation method. This installation method is as follows: The buoyancy tank is moved back (possibly by a service vessel) and the trail tug 650 pays in the Riser tow line 640 and moves back 150 m towards the riser 600. The paying in of the tow rope causes the URTA 610 to rise towards the water surface. The buoyancy tank 630 is then rotated 90 degrees (again the service vessel will probably do this) to allow room for the permanent chain connection to be made.

With the buoyancy tank 630 rotated, the service vessels pays in the 60 m permanent chain section 660*a* from the buoyancy tank 630, and the 60 m permanent chain section 660*b* on the URTA 610. The permanent chain link between the buoyancy tank 630 and the URTA 610 (and therefore the riser 600) is made on the shark jaws of the service vessel. The resulting situation is shown in FIG. 4*a*. This shows the buoyancy tank 630 at 90 degrees with the permanent chain connection 660 in place. The trail tug 650 (now about 100 m from the URTA 610) is still connected to the URTA 610 by riser tow line 640. The buoyancy tank tow line 620 is still connected between the buoyancy tank 630 and the URTA 610 and is now slack.

The slack buoyancy tank tow line 620 is now disconnected from the triplate swivel 700 and is then passed on to the trail tug 650. Therefore this line 620 is now connected between the trail tug 650 and the top of the buoyancy tank 630. This line 620 is then winched taut. The riser towing line 640 is then released. This situation is shown in FIG. 4*b*. It can be seen that the tension now goes through the buoyancy tank towing line 620, buoyancy tank 620 and permanent chain 660. The triplate swivel 700 is then removed to give room to the permanent buoyancy tank shackle, and the permanent buoyancy tank shackle is secured. The upending process can now begin with the lead tug paying out the dead man anchor. The upending process is described in US06082391 and is incorporated herein by reference.

One issue with the Hybrid Riser Tower as described (with chain connection to the buoyancy tank) is the coil tubing access. This was previously done by having access to the coil tubing unit to be from directly vertically above the URTA. In this case the buoyancy tank was rigidly connected with a taper joint. However access from vertically above is not possible with the buoyancy tank attached to a chain also directly vertically above the URTA.

Figure 9A:
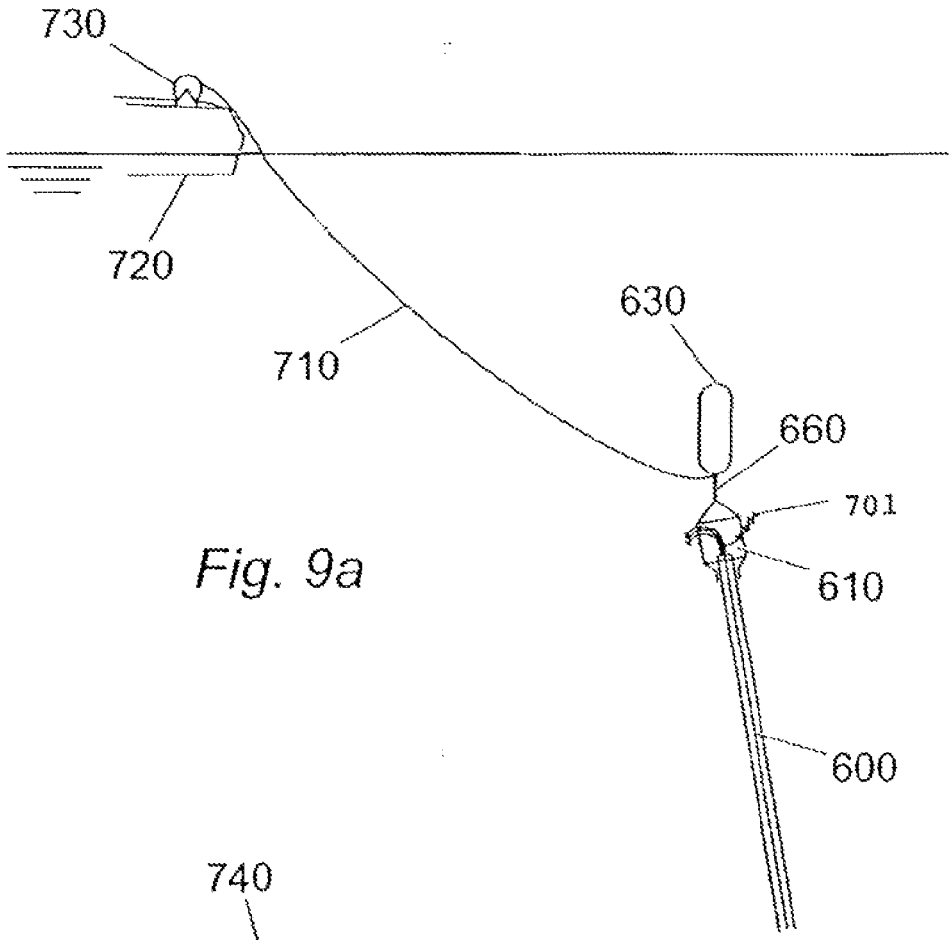
FIGS. 9*a* and 9*b* depict a method for accessing the coil tubing according to a second embodiment of the invention.
Figure 9B:
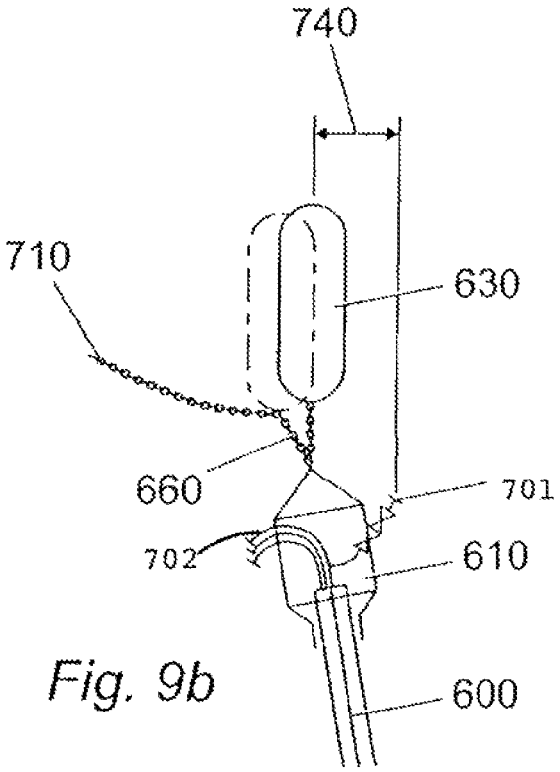

FIGS. 9*a* and 9*b* depict a method for accessing the coil tubing access unit for a Hybrid Riser Tower which has its buoyancy tank attached non-rigidly, for instance with a chain, as in this example. This shows the top part of the installed riser tower (which may have been installed by the method described above), and in particular the riser 600, URTA 610, buoyancy tank 630, permanent chain link 660, the coil tubing access unit 701, goosenecks 702, and a temporary line 710 from a winch 730 on the Floating Production, Storage and Offloading (FPSO) Vessel 720 to the bottom of the buoyancy tank 630.

The method comprises attaching the temporary line 710 from the winch 730 on the FPSO 720 to the bottom of the buoyancy tank 630 and using the winch 730 to pull this line 710 causing the riser assembly to move off vertical. This provides the necessary clearance 740 for the coil tubing access.

The inventors have recognised that, with the buoyancy tank 630 connected by a chain 660, the temporary line 710 should be attached to the bottom of the buoyancy tank 630. Should it be connected to the top of the buoyancy tank 630, the tank tends only to rotate, while connection to the URTA 610 means that the buoyancy tank 630 tends to remain directly above and still preventing the coil tubing access.

The above embodiments are for illustration only and other embodiments and variations are possible and envisaged without departing from the spirit and scope of the invention. For example it is not essential that the buoyancy tank be towed with the riser to the installation site (although this is likely to be the lower cost option), the buoyancy tank may be transported separately and attached prior to upending.

The invention claimed is:

1. A riser system comprising a plurality of conduits extending in use from a seabed toward a sea surface and having an upper end supported at a depth below the sea surface, the plurality of conduits forming a riser bundle and the riser system further comprising a central structural core, wherein said riser system further comprises a plurality of guide frames adapted to guide the plurality of conduits and spaced at intervals around at least a part of a length of the central structural core, wherein each guide frame of the plurality of guide frames has two or more buoyant blocks mounted thereto, and wherein for each guide frame, said two or more buoyant blocks attached thereto are arranged symmetrically around said central structural core to form a substantially circular cross-section but are retained by said guide frame so that each buoyant block of the two or more buoyant blocks is separated from each other buoyant block of the two or more buoyant blocks by a fluid permeable gap, wherein a width of the gap is greater than a radius of each conduit of the plurality of conduits guided by a respective guide frame to allow access to the plurality of conduits without removing any of the buoyant blocks.

2. The riser system as claimed in claim 1 wherein the central structural core comprises a first conduit of said plurality of conduits said other conduits being arranged around said first conduit.

3. The riser system as claimed in claim 2 wherein said other conduits are arranged substantially symmetrically around said first conduit.

4. The riser system as claimed in claim 2 wherein said first conduit is a fluid injection line and said other conduits consist of production lines.

5. The riser system as claimed in claim 4 wherein said fluid injection line is a water injection line.

6. The riser system as claimed in claim 4 wherein said fluid injection line is a gas injection line.

7. The riser system as claimed in claim 4 wherein two such production lines are provided.

8. The riser system as claimed in claim 7 wherein at least one of said production lines is thermally insulated.

9. The riser system as claimed in claim 8 wherein both production lines are thermally insulated.

10. The riser system as claimed in claim 8 wherein one of said production lines is thermally insulated, the uninsulated line being used as a service line.

11. The riser system as claimed in claim 8 wherein said thermal insulation is in the form of a pipe-in-pipe structure with the annular space used as a gas lift line.

12. The riser system as claimed in claim 1 wherein said riser system comprises three conduits arranged substantially symmetrically around the central structural core, wherein a first of said conduits is a fluid injection line, said other conduits being production lines.

* * * * *